US008734244B2

(12) United States Patent
LeMay et al.

(10) Patent No.: US 8,734,244 B2
(45) Date of Patent: May 27, 2014

(54) THIN CLIENT SUPPORT FOR A GAMING MACHINE

(75) Inventors: Steven G. LeMay, Reno, NV (US); Dwayne R. Nelson, Las Vegas, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 13/609,526

(22) Filed: Sep. 11, 2012

(65) Prior Publication Data

US 2014/0073390 A1 Mar. 13, 2014

(51) Int. Cl.
*G07F 17/32* (2006.01)

(52) U.S. Cl.
USPC ..... 463/29; 463/16; 463/20; 463/25; 463/42

(58) Field of Classification Search
USPC ..... 463/16, 20, 25, 29
See application file for complete search history.

(56) References Cited

U.S. PATENT DOCUMENTS

| | | | |
|---|---|---|---|
| 4,856,787 | A | 8/1989 | Itkis |
| 2005/0153778 | A1 | 7/2005 | Nelson et al. |
| 2007/0167210 | A1 | 7/2007 | Kelly et al. |
| 2007/0270211 | A1 | 11/2007 | Moshal |
| 2008/0167113 | A1 | 7/2008 | Plowman |
| 2009/0036190 | A1 * | 2/2009 | Brosnan et al. ..... 463/16 |

FOREIGN PATENT DOCUMENTS

WO WO-2008/112783 9/2008

OTHER PUBLICATIONS

"IGT Service Window," IGT Network Systems, 2010, 2 pages.
"Service Window Systems," IGT, 2011, 1 page.
en.wikipedia.org/wiki/Thin_client; "Thin client," Wikipedia.org, retrieved Jun. 19, 2012, 5 pages.
gaming.hermes-softlab.com/gaming_vendors/g2s_protocol/protocol_stack.asp; "G2S Protocol-Stack," ComTrade Gaming Competence Center, retrieved May 16, 2012, 2 pages.
http://reviews.cnet.com/8301-12261_7-57433025-10356022/ericsson-could-turn-you-into-a-human-usb-connection-next-year/; "Ericsson Could Turn You Into a Human USB Connection Next Year," CNET Reviews, retrieved Sep. 10, 2012, 10 pages.

* cited by examiner

*Primary Examiner* — Omkar Deodhar
(74) *Attorney, Agent, or Firm* — Foley & Lardner LLP

(57) ABSTRACT

A gaming machine, such as a video slot or video poker machine, may be configured to request a thin client game from a game server for presentation within a thin client. The outcome of the thin client game is determined by the game server. The gaming machine is also configured to execute a thick client game determined by the gaming machine. Indications of the outcomes of the thin and thick client games may be provided to a data collection device.

18 Claims, 4 Drawing Sheets

THIN CLIENT SUPPORT FOR A GAMING MACHINE

BACKGROUND

1. Field of the Described Embodiments

The present disclosure relates generally to gaming machines, and more particularly to using a thin client within a gaming machine.

2. Description of the Related Art

Many of today's gaming casinos and other entertainment locations feature different single and multi-player gaming systems such as slot machines and video poker machines. The gaming machines may include a number of hardware and software components to provide a wide variety of game types and game playing capabilities. Exemplary hardware components may include bill validators, coin acceptors, card readers, keypads, buttons, levers, touch screens, coin hoppers, ticket printers, player tracking units and the like. Software components may include, for example, boot and initialization routines, various game play programs and subroutines, credit and payout routines, image and audio generation programs, various component modules and a random or pseudo-random number generator, among others.

Gaming machines are highly regulated to ensure fairness. In many cases, gaming machines may be operable to dispense monetary awards of a large amount of money. Accordingly, access to gaming machines is often carefully controlled. For example, in some jurisdictions, routine maintenance requires that extra personnel (e.g., gaming control personnel) be notified in advance and be in attendance during such maintenance. Additionally, gaming machines may have hardware and software architectures that differ significantly from those of general-purpose computers (PCs), even though both gaming machines and PCs employ microprocessors to control a variety of devices. For example, gaming machines may have more stringent security requirements and fault tolerance requirements. Additionally, gaming machines generally operate in harsher environments as compared with PCs.

In many casinos and other entertainment locations, the gaming machines may be networked to one or more devices that monitor the functions of the gaming machines during operation. For example, an accounting system may monitor the amount of credits received by a gaming machine and the amount of credits paid out by the gaming machine. Such an accounting system allows the operator of the gaming machines to analyze the profitability of the gaming machines, the use of the gaming machines, and similar metrics.

One or more thick-client games may be installed on a gaming machine. A thick-client game refers to a game in which all of the software necessary to play the game resides within memory of the gaming machine itself. In other words, all of the graphics of the game and logic to run the game may reside on the gaming machine itself. For example, a gaming machine may be loaded with any number of thick-client games (e.g., a slot game, a poker game, etc.). A thick-client game may also include the outcome determining logic for the game. Thus, the gaming machine itself may determine whether a user has won or lost the game. To provide an accounting, the operating system of the gaming machine may be configured to receive an indication of the outcome from the game and communicate the outcome to a remote accounting server.

The operating system of a gaming machine may be configured to use one of a variety of gaming protocols, i.e., communications protocols specifically designed for use in a gaming environment, such as a casino. One exemplary protocol is the Slot Accounting System (SAS) Protocol, pioneered by International Game Technology (IGT) and recognized in 2002 by the Gaming Standards Association (GSA) as an industry standard. A more recent communications protocol in the gaming industry is the Game to System (G2S) Protocol, also recognized by the GSA as an industry standard. Thus, many casinos and other gaming environments may have existing infrastructure to support the collection of accounting data from deployed gaming machines.

SUMMARY

According to various example embodiments, a method of using a thin client in a gaming machine is disclosed. The method includes requesting, via a network interface, a thin client game from a game server for presentation within a thin client, an outcome of the thin client game being determined by the game server. The method also includes receiving, from the game server, the outcome of the thin client game and providing, via the thin client, an indication of the outcome of the thin client game to a data collection device. The method further includes executing, by a processor of the gaming machine, a thick client game, an outcome of the thick client game being determined by the gaming machine. The method yet further includes providing an indication of the outcome of the thick client game to the data collection device.

According to one example embodiment, a controller for a gaming machine is disclosed. The controller includes a processor configured to request a thin client game from a game server for presentation within a thin client, an outcome of the thin client game being determined by the game server. The processor is also configured to receive, from the game server, the outcome of the thin client game and provide, via the thin client, an indication of the outcome of the thin client game to a data collection device. The processor is further configured to execute a thick client game, an outcome of the thick client game being determined by the gaming machine and to provide an indication of the outcome of the thick client game to the data collection device.

According to another example embodiment, a computer-readable storage medium is disclosed. The storage medium has machine instructions stored therein, the instructions being executable by a processor to cause the processor to perform operations. The operations include requesting a thin client game from a game server for presentation within a thin client. An outcome of the thin client game is determined by the game server. The operations also include receiving, from the game server, the outcome of the thin client game and providing, via the thin client, an indication of the outcome of the thin client game to a data collection device. The operations further include executing a thick client game, an outcome of the thick client game being determined by the gaming machine. The operations also include providing an indication of the outcome of the thick client game to the data collection device.

BRIEF DESCRIPTION OF THE DRAWINGS

The details of one or more implementations are set forth in the accompanying drawings and the description below. Other features, aspects, and advantages of the disclosure will become apparent from the descriptions, the drawings, and the claims, in which:

DETAILED DESCRIPTION

Numerous specific details may be set forth below to provide a thorough understanding of concepts underlying the described embodiments. It may be apparent, however, to one skilled in the art that the described embodiments may be practiced without some or all of these specific details. In other instances, some process steps have not been described in detail in order to avoid unnecessarily obscuring the underlying concept.

Figure 1:
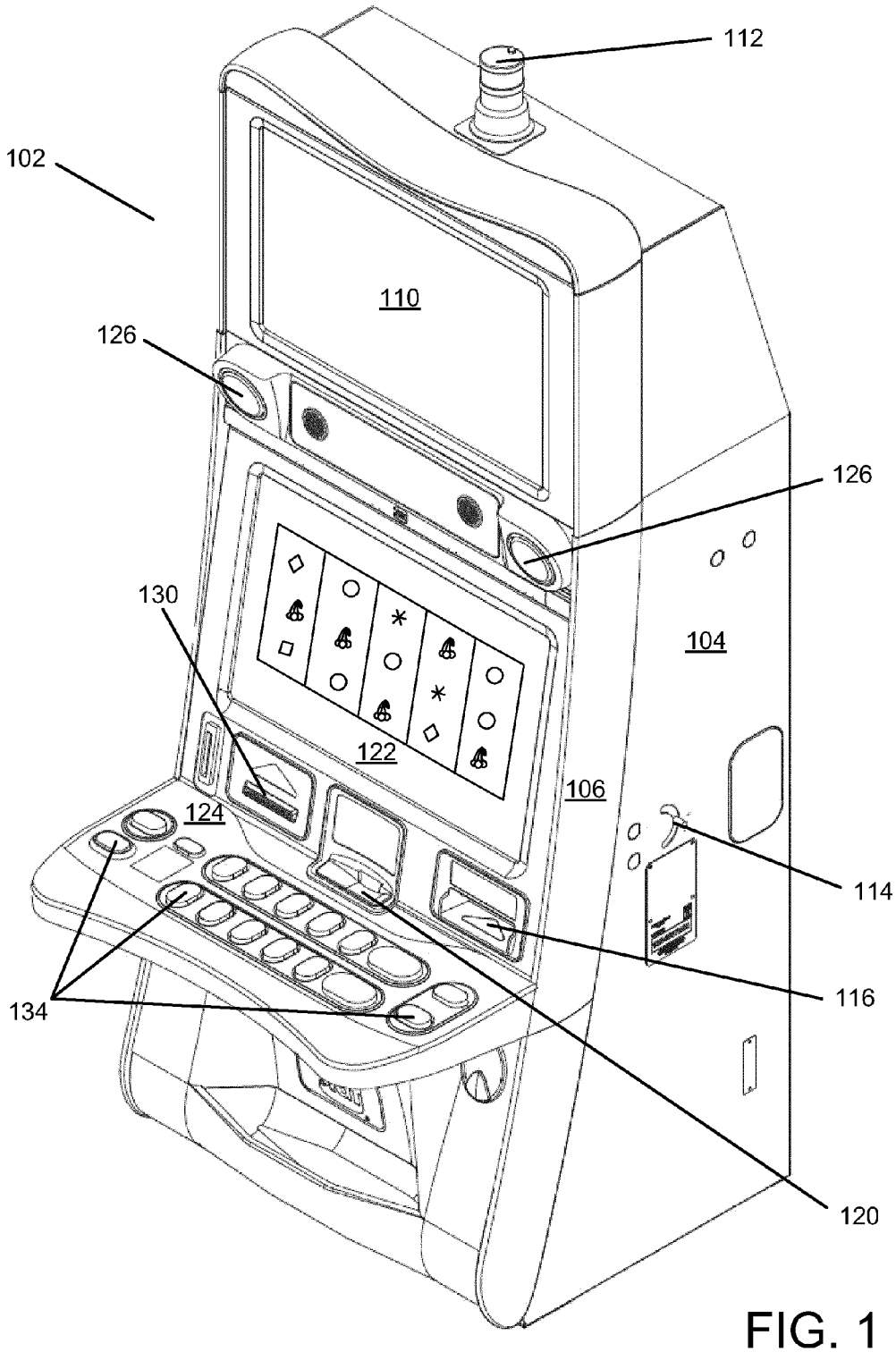
FIG. 1 is an illustration of a gaming machine, according to an exemplary embodiment.

Referring to FIG. 1, a perspective drawing of an electronic gaming machine 102 is shown in accordance with described embodiments. Gaming machine 102 may include a main cabinet 104. Main cabinet 104 may provide a secure enclosure that prevents tampering with device components, such as a game controller (not shown) located within the interior of main cabinet 104. Main cabinet 104 may include an access mechanism, such as a door 106, which allows the interior of gaming machine 102 to be accessed. Actuation of a door 106 may be controlled by a locking mechanism 114. In some embodiments, locking mechanism 114, door 106, and the interior of main cabinet 104 may be monitored with security sensors of various types to detect whether the interior has been accessed. For instance, a light sensor may be provided within main cabinet 104 to detect a change in light-levels when door 106 is opened and/or an accelerometer may be attached to door 106 to detect when door 106 is opened.

Gaming machine 102 may include any number of user interface devices that convey sensory information to a user and/or receive input from the user. For example, gaming machine 102 may include electronic displays 110, 122, speakers 126, and/or a candle device 112 to convey information to the user of gaming machine 102. Gaming machine 102 may also include a console 124 having one or more inputs 134 (e.g., buttons, track pads, etc.) configured to receive input from a user. In one embodiment, display 110 and/or display 122 may also be a touch screen display configured to receive input from a user. A controller (not shown) within gaming machine 102 may run a game, such as a wager-based game, in response to receiving input from a user via inputs 134, display 122, or display 110. For example, inputs 134 may be operated to place a wager in the game and to run the game. In response, the controller may cause reels shown on display 122 to spin, such as with a software-based slot game.

Gaming machine 102 may also include devices for conducting a wager-based game. For example, gaming machine 102 may include a ticket acceptor 116 and a printer 120. In various embodiments, gaming machine 102 may be configured to run on credits that may be redeemed for money and/or other forms of prizes. Ticket acceptor 116 may read an inserted ticket having one or more credits usable to play a game on gaming machine 102. For example, a player of gaming machine 102 may wager one or more credits within a video slot game. If the player loses, the wagered amount may be deducted from the player's remaining balance on gaming machine 102. However, if the player wins, the player's balance may be increased by the amount won. Any remaining credit balance on gaming machine 102 may be converted into a ticket via printer 120. For example, a player of gaming machine 102 may cash out of the machine by selecting to print a ticket via printer 120. The ticket may then be used to play other gaming machines or redeemed for cash and/or prizes. According to various embodiments, gaming machine 102 may record data regarding its receipt and/or disbursement of credits. For example, gaming machine 102 may generate accounting data whenever a result of a wager-based game is determined. In some embodiments, gaming machine 102 may provide accounting data to a remote data collection device, allowing the remote monitoring of gaming machine 102.

In one embodiment, gaming machine 102 may include a loyalty card acceptor 130. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing gaming machine 102. For example, a user having a loyalty account may be given a bonus turn on gaming machine 102 or credited loyalty points for playing gaming machine 102. Such loyalty points may be exchanged for loyalty rewards (e.g., a free meal, a free hotel stay, free room upgrade, discounts, etc.).

Figure 2:
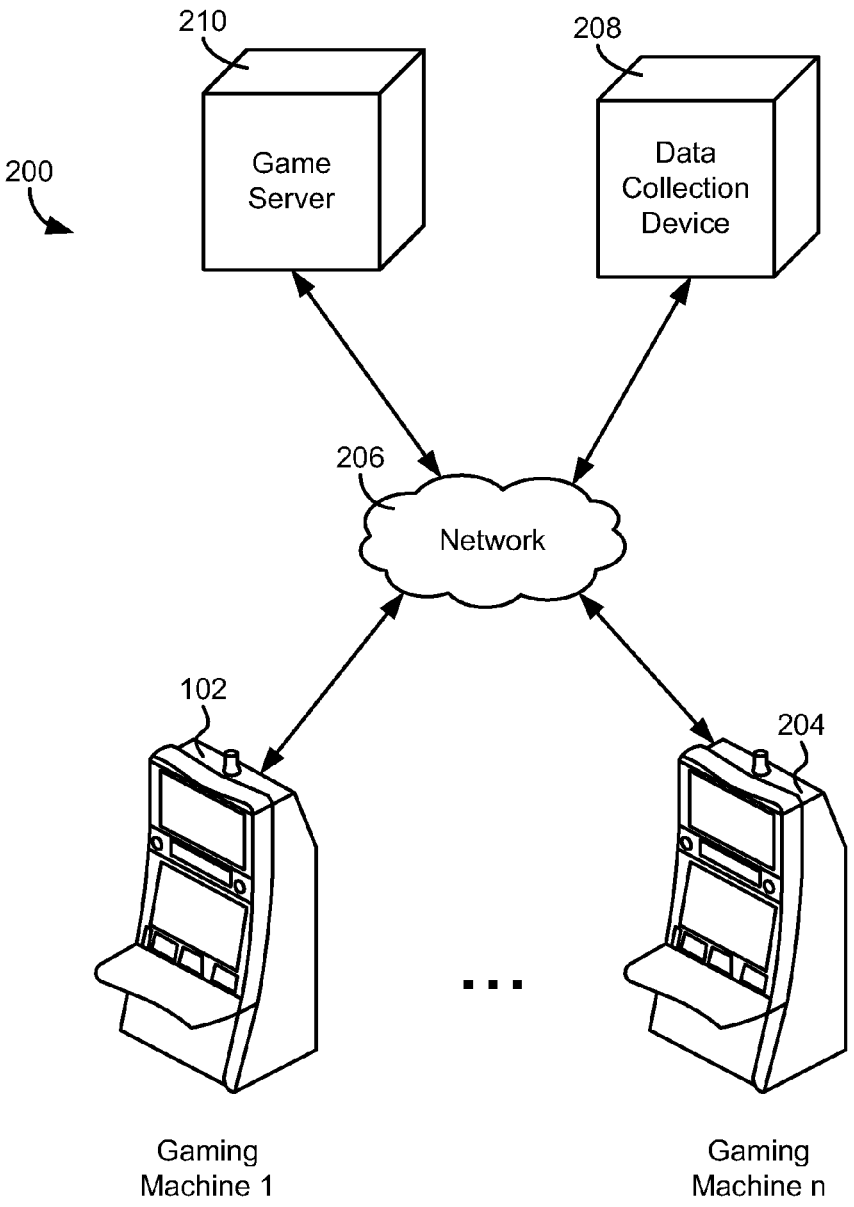
FIG. 2 is an illustration of a gaming environment, according to an exemplary embodiment.

Referring now to FIG. 2, an illustration of a gaming environment 200 is shown, according to an exemplary embodiment. Gaming environment 200 may be within, for example, a casino, a racetrack, a hotel, or other entertainment location. As shown, gaming environment 200 may include any number of gaming machines. For example, gaming environment 200 may include gaming machine 102 shown in FIG. 1 through a gaming machine 204 (i.e., a first gaming machine through nth gaming machine). Gaming environment may also include a network 206 through which gaming machines 102, 204, a data collection device 208, and a game server 210 communicate.

Network 206 may be any form of communications network that conveys data between gaming machines 102, 204, data collection device 208 and game server 210. Network 206 may include any number wired or wireless connections. For example, data collection device 208 may communicate over a wired connection that includes a serial cable, a fiber optic cable, a CAT5 cable, or any other form of wired connection. Similarly, data collection device 208 may communicate via a wireless connection (e.g., via WiFi, cellular, radio, etc.). Network 206 may also include any number of intermediary networking devices, such as routers, switches, servers, etc.

Data collection device 208 may be one or more electronic devices connected to network 206 configured to collect data from gaming machines 102, 204. For example, data collection device 208 may be a single computer, a collection of computers, or a data center. Data collection device 208 may include one or more data storage devices in communication with one or more processors. The data storage devices may store machine instructions that, when executed by the one or more processors, cause the one or more processors to perform the functions described with regard to data collection device 208. Generally, data collection device 208 is configured to receive and store data regarding gaming machines 102, 204 and to provide the data to a user interface (e.g., a display, a handheld device, etc.). In some cases, data collection device 208 may perform data analysis on the received data. For example, data collection device 208 may determine averages, trends, metrics, etc., for one or more of gaming machines 102, 204. Data may be sent by gaming machines 102, 204 to data collection device 208 in real-time (e.g., whenever a change in credits or cash occurs, whenever another type of system event occurs, etc.), periodically (e.g., every fifteen minutes, every hour, etc.), or in response to a request from data collection device 208.

The data received by data collection device 208 from gaming machines 102, 204 via network 206 may include accounting data. Accounting data may be, but is not limited to, data indicative of credits received or paid out by gaming machines 102, 204. Data collection device 208 may process the collected accounting data and generate one or more reports regarding the financial state of gaming machines 102, 204 (e.g., the amount of money that a gaming machine has generated or lost, the amount of use of the gaming machine by players, which games were played on the machine, etc.).

The data received by data collection device 208 may include operational data. In general, operational data may be any other form of data indicative of the operational state of gaming machines 102, 204. For example, operational data may include data indicative of the number of games played on gaming machines 102, 204, the types of games played on gaming machines 102, 204, errors or alerts generated by gaming machines 102, 204, whether gaming machines 102, 204 are currently in use, etc. Data collection device 208 may use the received operational data to allow gaming machines 102, 204 to be monitored. Data collection device 208 may also provide notifications if maintenance is required for any of gaming machines 102, 204. For example, a notification may be sent to a display (e.g., a display attached to data collection device 208, a display of a handheld device operated by a technician, etc.), so that an error may be corrected.

In some embodiments, the data received by data collection device 208 may include data related to a user's loyalty account. For example, a user of gaming machine 102 may link their loyalty account to gaming machine 102, so that she can gain loyalty points, free turns, etc., while playing gaming machine 102. A user may link his or her loyalty account to gaming machine 102 in any number of ways. For example, the user may insert a loyalty card into gaming machine 102, provide biometric data to gaming machine 102 (e.g., by conducting a finger print scan, a retinal scan, etc.), and so on. In some cases, a mobile device operated by the user may provide data regarding the user's loyalty account to gaming machine 102. The mobile device may transfer data to gaming machine 102 wirelessly (e.g., via Bluetooth, WiFi, etc.), via a wired connection (e.g., via a USB cable, a docking station, etc.), via the user's body (i.e., the mobile device transmits data through the user's body and into gaming machine 102), or in another manner. Data collection device 208 may then associate the user's time playing gaming machine 102 with the user's loyalty account (e.g., to add loyalty points to the user's account, to provide certain rewards to the user, such as a bonus turn, etc.).

Data collection device 208 may provide data to gaming machines 102, 204 via network 206. For example, data collection device 208 may notify a user of gaming machine 102 that the user qualifies for a loyalty award, such as a free meal, a free night in a hotel, a discount, a bonus turn, or other loyalty-related information. In some cases, data collection device 208 may provide a service window to gaming machine 102 via display 122. For example, the service window may appear within a Flash application executed by gaming machines 102, 204. A service window may allow notifications to be provided by data collection device 208 to an individual user during game play.

Similar to data collection device 208, game server 210 may be one or more electronic devices connected to network 206 (e.g., a computer, a data center, a cloud-computing platform, etc.). Game server 210 may be configured to provide games to gaming machines 102, 204. In some embodiments, game server 210 may provide a thick-client game to one of gaming machines 102, 204. For example, a thick client game may be downloaded and installed on gamine machine 102 by game server 210. In some embodiments, the downloaded game may be validated by gaming machine 102 prior to being playable (e.g., to ensure the outcome determining logic of the game has not been altered).

According to various embodiments, gaming machines 102, 204 may execute operating systems configured to collect and relay accounting, operational, and other data from thick client games to data collection device 208. The operating systems of gaming machines 102, 204 may be specialized operating systems configured for use in a gaming environment. In some embodiments, the operating system of one of gaming machines 102, 204 may be a real-time operating system (RTOS). In general, an RTOS is configured to minimize or eliminate the amount of task blocking as executing tasks compete for hardware resources.

In some cases, gaming environment 200 may be preconfigured to use thick client games on gaming machines 102, 204. For example, a casino may have a pre-existing infrastructure that is configured to operate with a number of deployed thick-client gaming machines. The operating system of gaming machine 102 may be configured to execute thick client games (e.g., games provided by the manufacturer of the gaming machine). In other words, the operating systems of gaming machines 102, 204 and the thick client games on the machines may be tightly integrated as part of a closed environment. In various embodiments, the operating systems of gaming machines 102, 204 may relay data from thick client games to data collection device 208 using a gaming communication protocol, such as G2S or SAS. Data collection device 208 may be configured to receive accounting, operational, and other forms of data from gaming machine 102, 204. Thus, the infrastructure to install, run, and monitor thick client games in gaming environment 200 may be pre-existing, according to some embodiments.

A thin client may be installed on one or more of gaming machines 102, 204. As opposed to thick client games in which the gaming machine determines the outcome of the game, the game-determining logic of a thin client game may be executed by a remote device, such as game server 210. The graphics, sound, and other data of the game may be part of the thin client itself, or may even be streamed to the gaming machine, in various embodiments. Validation of the game's logic may be performed at game server 210, allowing games to be deployed quickly to gaming machines 102, 204. For example, a player of gaming machine 102 may be presented with a menu that includes a listing of thin client games on game server 210 that are available for play.

According to various embodiments, a thin client may be configured to appear as a thick client game to the gaming machine's operating system. Such a client may, from the perspective of the operating system, appear as a single thick client game. For example, two thick client games and one thin client may be installed on gaming machine 102. From the perspective of the machine's operating system, three thick client games are installed. However, any number of games may now be playable on gaming machine 102 via the installed thin client. In some embodiments, the thin client may be configured to provide accounting, operational, and other reporting data to data collection device 208, as if it were another thick client game. In other words, gaming machine 102 may execute both thin and thick client games and report the outcomes of both types of games to data collection device 208.

Figure 3:
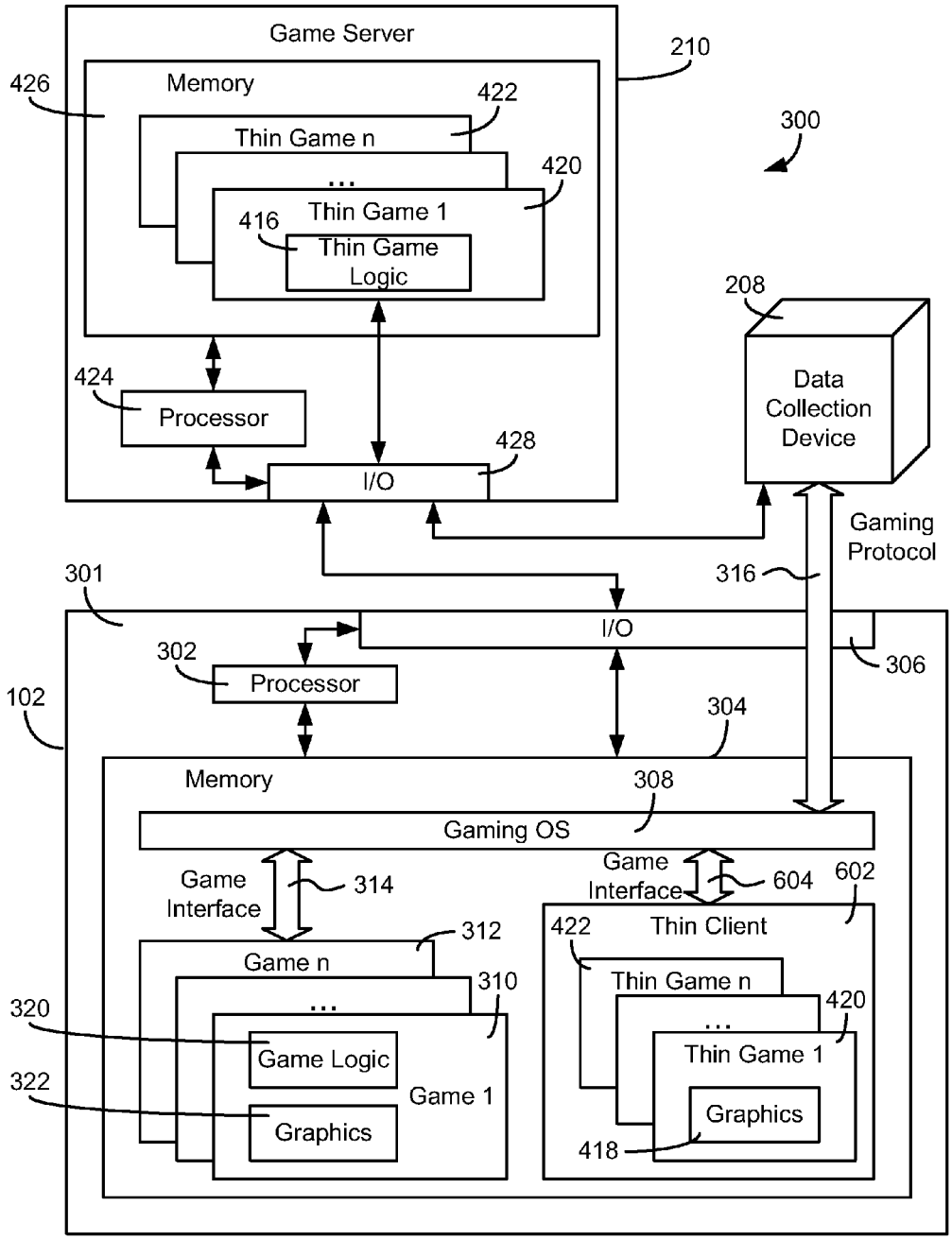
FIG. 3 is a block diagram of a gaming machine configured to use thin and thick client games, according to one embodiment.

Referring now to FIG. 3, a block diagram 300 of a gaming machine configured to use thin and thick client games is shown, according to an exemplary embodiment. In the example shown, gaming machine 102 of FIGS. 1-2 may be configured to run both thick client games 310-312 and a thin client 602 via gaming OS 308. As shown, gaming machine 102 may include a controller 301 that controls some or all of the operations of gaming machine 102. For example, controller 301 may provide control commands to an electronic display (e.g., displays 110, 122 shown in FIG. 1), to cause the display to show certain indicia. Similarly, controller 301 may communicate with data collection device 208 and game server 210 via input and output (I/O) hardware 306.

Controller 301 may include a processor 302 and a memory 304. Memory 304 stores machine instructions that, when executed by processor 302, cause processor 302 to perform one or more operations described herein. Processor 302 may include a microprocessor, FPGA, ASIC, any other form of processing electronics, or combinations thereof. Memory 304 may be any electronic storage medium such as, but not limited to, a floppy disk, a hard drive, a CD-ROM, a DVD-ROM, a magnetic disk, RAM, ROM, EEPROM, EPROM, flash memory, optical memory, or combinations thereof. Memory 304 may be a tangible storage medium that stores non-transitory machine instructions. Controller 301 may include any number of processors and memories. In other words, processor 302 may represent the collective processing devices of controller 301 and memory 304 may represent the collective storage devices of controller 301. Processor 302 and memory 304 may be on the same printed circuit board or may be in communication with each other via a bus or other form of connection.

I/O hardware 306 includes the interface hardware used by controller 301 to receive data from other devices and/or to provide data to other devices. For example, a command may be sent from controller 301 to a controlled device of gaming machine 102 via I/O hardware 306. I/O hardware 306 may include, but is not limited to, hardware to communicate on a local system bus and/or on a network. For example, I/O hardware 306 may include a port to transmit display data to an electronic display and another port to receive data from data collection device 208 via a network, such as network 206 shown in FIG. 2.

Similar to gaming machine 102, game server 210 may include processing components, such as a processor 424, a memory 426, and I/O hardware 428. Memory 424 may store instructions that, when executed by processor 424, cause game server 210 to perform the operations described herein. In cases in which game server 210 includes multiple computing devices, memory 426 may represent the combined memories of the devices and processor 424 may represent the combined processors of the devices. For example, game server 210 may represent a data center, set of computers, etc., in some cases.

Gaming machine 102 may store thick client games 310-312 in memory 304 (e.g., a first through nth game) for execution by processor 302, according to various implementations. In other words, each of games 310-312 may include all of the logic to run the game and determine the outcome of the game. For example, game 310 may include graphics 322 (e.g., the display data for the game provided to an electronic display) and game logic 320 (e.g., the logic used to conduct the game and determine its outcome). Game logic 320 may include one or more pseudo-random number generators used to determine the outcome of the particular game. Games 310-312 may be of a certain type or may be of varying types. For example, games 310-312 may be different slot games or game 310 may be a slot game and game 312 may be a poker game. Games 310-312 may be installed in memory 304 by a technician or may be installed remotely by data collection device 208.

In various embodiments, gaming machine 102 may use a "state" machine architecture. In a state machine architecture, critical information in each state is identified and queued for storage to memory 304. The architecture does not advance to the next state from a current state until all of the critical information that is queued for storage for the current state is stored to persistent memory. Thus, if an error condition occurs between two states, such as a power failure, gaming machine 102 can be restored to its last state prior to the occurrence of the error condition by using the critical information associated with its last stored state. This feature is often called a "roll back" of the gaming machine. Examples of critical information can include, but are not limited to, an outcome determined for one of games 310-312, a wager amount made in one of games 310-312, an award amount associated with the outcome, credits available, and/or the amount of credits deposited to gaming machine 102.

Games 310-312 may be validated prior to being played by a user. In locations in which gambling is regulated, validation routines may be run on games 310-312 to ensure that they have not been altered from their original installations. For example, game 310 may be validated to ensure that game logic 320 has not been altered to affect the outcomes of game 310. Validation of a game may be performed at any time. However, the validation process may take several minutes per game, in some cases. To avoid affecting the playability of gaming machine 102, validation may be performed only at specific times, such as when gaming machine 102 is started, during a maintenance period, or after a new game is installed into memory 304. For example, game 312 may be installed into memory 304 and gaming machine 102 may be rebooted, to validate game 312.

Memory 304 may include a gaming operating system (OS) 308 that controls the execution of games 310-312. For example, gaming OS 308 may control which of games 310-312 are loaded into RAM for execution by processor 302. Gaming OS 308 may also provide a game interface 314, which passes data between a game, such as game 310, and gaming OS 308. For example, game logic 320 may determine the results of game 310 and provide an indication of the results to gaming OS 308 via game interface 314 (e.g., game 310 may provide accounting data to gaming OS 308). Gaming OS 308 may provide accounting data collected from games 310-312 to data collection device 208. Gaming OS 308 may also provide other data to data collection device 208, such as operational data (e.g., system alerts, errors, etc.) or data regarding a loyalty program. Gaming OS 308 may also receive data from data collection device 208. For example, gaming OS 308 may receive player notifications from data collection device 208 and provide the notifications to the display of gaming machine 102 (e.g., as part of a displayed service window).

In various embodiments, gaming OS 308 may communicate with data collection device 208 via a gaming communication protocol 316. Gaming communication protocol 316 may any form of communication protocol for use in a gaming environment. For example, gaming protocol 316 may be the SAS Protocol or G2S Protocol. In some cases, multiple gaming protocols may be used to communicate data between data collection device 208 and gaming machine 102. For example, game machine 102 may communicate via the SAS Protocol with an SAS<->G2S Protocol converter, which converts the message into the G2S Protocol and forwards the message to data collection device 208.

Gaming machine 102 may also be configured to run a thin client 602 stored in memory 304, according to various embodiments. Thin client 602 may be used to request one or more thin client games from game server 210. Game server 210 may be on the same network as data collection device 208 or may be on a different network. For example, data collection device 208 and game server 210 may be on the same local area network (LAN). In another example, data collection device 208 may be on a LAN with gaming machine 102, while game server 210 is accessible to gaming machine 102 via the Internet. In one embodiment, the functionality of data collection device 208 and game server 210 may be performed by the same device (e.g., data collection device 208 may also serve thin client games to thin client 602). Any number of games may be run in thin client 602. For example, game server 210 may execute the game logic for any of thin client games 420-422 and provide the resulting graphics and/or audio data to thin client 602. In other cases, each of thin client games 420-422 may have a corresponding thin client on gaming machine 102.

A thin-client game in games 420-422 may be run on game server 210 and the results of the game may be provided to gaming machine 102 for presentation to a user. In some embodiments, one or more of thin-client games 420-422 may be a wager-based game. Any number of games may be stored by game server 210 and provided to gaming machine 102 via thin client 602. The logic of each of thin client games 420-422 may reside in game server 210 and be executed by processor 424. For example, thin client game logic 416 may be executed by game server 210 when thin client game 420 is run. During execution of a thin client game, game result data may be provided by game logic 416 to thin client 602 on gaming machine 102. In some embodiments, thin client 602 may include various graphics 418, audio, or other data and provide the data to an interface based on the received game result data. For example, thin client 602 may provide display data in graphics 418 to an electronic display, if game logic 416 determines that the player won the game. In some embodiments, graphics 418 may be part of a video stream of thin client game 420 being executed on game server 210. In one embodiment, an individual thin client game on game server 210 may have its own corresponding thin client on gaming machine 102. For example, thin client game 420 may have a corresponding thin client on gaming machine 102 and thin client game 422 may have a different thin client on gaming machine 102.

In various embodiments, thin client 602 may appear as a thick client game to gaming OS 308. For example, thin client 602 may be a stub loader executing within a shell of gaming OS 308. Reporting data from thin client 602, such as accounting data, may be communicated to gaming OS 308 via a gaming interface 604. Gaming interface 604 may be configured to appear similar to game interface 314 for thick client games 310-312. Thus, reporting data from thin client 602 may be reported by gaming OS 308 to data collection device 208 in a manner similar to that of games 310-312. Data collection device 208 may associate the game information with the accounting data, to report on the performance of the various thin client games served by game server 210.

In one example, thin client 602 may be a web browser application executed by gaming machine 102 and thin client game 420 may be provided to the web browser by game server 210. In such a case, the HTML, javascript, and graphics 418 (e.g., the multimedia content, graphics, video, audio, etc.) of the game may be downloaded to gaming machine 102. A secure connection (e.g., https://) may be used to download the thin game files and to communicate data back to game server 210. For example, game coordination may be provided via Websocket connections to game server 210. In some cases, a Websocket interface may also be implemented in javascript to thin game logic to relay play information to gaming OS 308 via a stub game or wrapper. Thus, thin client game 420 may appear to gaming OS 308 as any other thick client game for purposes of accounting, loyalty, or any other form of reporting via a gaming protocol. In other examples, thin client 602 may be an Adobe Air or Adobe Flash Player and thin client game 420 may be implemented using ActionScript.

Data regarding a player's loyalty account may be communicated between gaming OS 308 and thin client 602 via gaming interface 604. In some implementations, game server 210 may be configured to process loyalty account rewards. For example, gaming OS 308 may receive loyalty account data from an inserted loyalty card, mobile device, or the like, and provide the loyalty account data to thin client 602. In turn, thin client 602 may provide the account data to game server 210, which may determines the awarding of loyalty points, bonus plays, and other similar loyalty rewards based on a user's interactions with thin client games 420-422. In another example, a player having a bonus spin associated with his loyalty account may use the bonus spin within one of thin client games 420-422 via gaming OS 308 providing an indication of the bonus spin to thin client 602.

In some implementations, loyalty account data may be provided by thin client 602 to data collection device 208 via gaming interface 604. For example, thin client 602 may provide data regarding a user's interactions with thin client games 420-422 to data collection device 208, to credit a player's loyalty account. Interactions may include, but are not limited to, the amount of a wager in thin client games 420-422, which of thin client games 420-422 is being played or has been played by the player, how often the player uses any of thin client games 420-422, the number of games played by the player, and other such data that may be used by data collection device 208.

Figure 4:
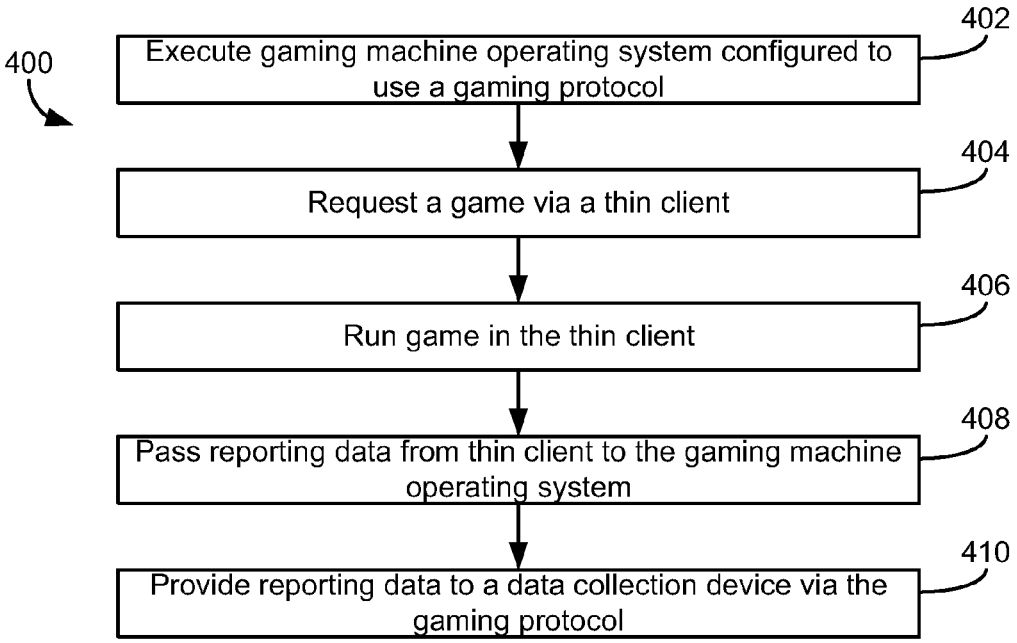
FIG. 4. is a flow diagram of a process for integrating a thin client game with a gaming machine, according to an exemplary embodiment.

Referring now to FIG. 4, a flow diagram of a process 400 for integrating a thin client game with a gaming machine is shown, according to an exemplary embodiment. Process 400 may be implemented by one or more processors executing machine instructions stored within one or more computer storage devices. For example, process 400 may be implemented by a gaming machine, such as gaming machine 102 shown in FIGS. 1-3. In general, process 400 may allow thin client games to be deployed to gaming machines in a pre-existing gaming environment having thick client gaming machines. Thus, the existing system architecture of the gaming environment may be leveraged, while still allowing the use of thin client games.

Process 400 includes executing a gaming machine operating system configured to use a gaming protocol (block 402). For example, a gaming machine may be configured to communicate via the SAS or G2S protocols with a data collection device. In some embodiments, the operating system may be a real-time operating system. In general, a real time operating system may be configured to minimize latency when executing an application, such as a game. In contrast to an operating system for a PC, the types of applications executable by the gaming machine operating system may be limited.

Process 400 includes requesting a game via a thin client (block 404). In some embodiments, one or more thin clients may be installed on the device running the gaming machine operating system. A thin client may be configured to run a particular game or may be configured to run multiple games. The request may be sent, for example, to a game server via a network. Requests may also be sent from the thin client to a plurality of game servers. For example, game servers may be mirrored, to provide redundancy in case one of the servers is unavailable.

Process 400 includes running the game in the thin client (block 406). During execution of the game, the actual logic of the game may be executed on a remote device, such as a gaming server. Graphics and/or audio generated by the executed game may then be communicated by the remote device to the thin client and presented to a user (e.g., via one or more displays or speakers).

Process 400 also includes passing reporting data from the thin client to the gaming machine operating system (block 408). In various embodiments, reporting data may include accounting data (e.g., the results of a wager-based game, the amount of physical money held by the gaming machine, etc.), operational data (e.g., an error that was encountered during the game, an alert, or other data regarding the operational state of the gaming machine), and/or loyalty account data (e.g., data regarding loyalty points accrued by the user while playing the game, bonus turns granted to the user, non-monetary awards granted to the user, etc.).

In some embodiments, the thin client may be configured to run within a shell of the gaming operating system. For example, multiple thin client games may be run within a single thin client game shell or in individual shells. In one embodiment, a thin client may be a stub loader that identifies itself to the gaming operating system as a single thick client game. For example, assume that the gaming machine has a single thin client and two thick client games installed. From the perspective of the gaming operating system, three games may appear as being installed (e.g., "slots," "blackjack," and "thin client game"). However, any number of games may be run on the gaming machine via the thin client.

Process 400 includes providing the reporting data to a data collection device via the gaming protocol (block 410). In some embodiments, the gaming machine operating system may provide the reporting data in the same manner as reporting data from any thick client games installed on the gaming machine. For example, the gaming machine may provide data regarding two thick client games and the thin client via the SAS or G2S Protocol. In one embodiment, the game server that executes the logic for the thin client game may communicate data to the data collection device, to provide additional information for reporting purposes. For example, the game server may provide data to the data collection device regarding which thin client game was actually running at the time.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on one or more computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing apparatus on data stored on one or more computer-readable storage devices or received from other sources.

The term "client or "server" include all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

What is claimed is:

1. A method of using a thin client in a gaming machine comprising:

requesting, via a network interface, a thin client game from a game server for presentation within a thin client, wherein an outcome of the thin client game is determined by the game server;

running the thin client in a separate shell of an operating system of the gaming machine that is configured to use a gaming communication protocol to report an outcome of a game to a data collection device;

receiving, from the game server, the outcome of the thin client game;

receiving, at the operating system, an indication of the outcome of the thin client game from the thin client;

providing, via the thin client, the indication of the outcome of the thin client game to the data collection device using the gaming communication protocol;

executing, by a processor of the gaming machine, a thick client game, wherein an outcome of the thick client game is determined by the gaming machine; and providing an indication of the outcome of the thick client game to the data collection device using the gaming communication protocol.

2. The method of claim 1, wherein the gaming protocol is the Slot Accounting System Protocol.

3. The method of claim 1, wherein the gaming protocol is the Game to System Protocol.

4. The method of claim 1, wherein the thin client game comprises a video stream from the game server.

5. The method of claim 1, wherein the thin client comprises a stub loader executing within the separate shell of the operating system.

6. The method of claim 1, wherein the operating system is a real-time operating system.

7. A controller for a gaming machine comprising a processor configured to:

request a thin client game from a game server for presentation within a thin client, wherein an outcome of the thin client game is determined by the game server;

run the thin client in a separate shell of an operating system of the gaming machine that is configured to use a gaming communication protocol to report an outcome of a game to a data collection device;

receive, from the game server, the outcome of the thin client game;

receiving, at the operating system, an indication of the outcome of the thin client game from the thin client;

provide, via the thin client, an indication of the outcome of the thin client game to the data collection device using the gaming communication protocol;

execute a thick client game, wherein an outcome of the thick client game is determined by the gaming machine; and provide an indication of the outcome of the thick client game to the data collection device using the gaming communication protocol.

8. The controller of claim 7, wherein the gaming protocol is the Slot Accounting System Protocol.

9. The controller of claim 7, wherein the gaming protocol is the Game to System Protocol.

10. The controller of claim 7, wherein the thin client game comprises a video stream from the game server.

11. The controller of claim 7, wherein the thin client comprises a stub loader executing within the separate shell of the operating system.

12. The controller of claim 7, wherein the operating system is a real-time operating system.

13. A non-transitory computer-readable storage medium having machine instructions stored therein, the instructions being executable by a processor to cause the processor to perform operations comprising:

requesting a thin client game from a game server for presentation within a thin client, wherein an outcome of the thin client game is determined by the game server;

running the thin client in a separate shell of an operating system of the gaming machine that is configured to use a gaming communication protocol to report an outcome of a game to a data collection device;

receiving, from the game server, the outcome of the thin client game;

receiving, at the operating system, an indication of the outcome of the thin client game from the thin client;

providing, via the thin client, an indication of the outcome of the thin client game to the data collection device using the gaming communication protocol;

executing a thick client game, wherein an outcome of the thick client game is determined by the gaming machine; and providing an indication of the outcome of the thick client game to the data collection device using the gaming communication protocol.

14. The computer-readable storage medium of claim 13, wherein the gaming protocol is the Slot Accounting System Protocol.

15. The computer-readable storage medium of claim 13, wherein the gaming protocol is the Game to System Protocol.

16. The computer-readable storage medium of claim 13, wherein the thin client game comprises a video stream from the game server.

17. The computer-readable storage medium of claim 13, wherein the thin client comprises a stub loader executing within the separate shell of the operating system.

18. The computer-readable storage medium of claim 13, wherein the operating system is a real-time operating system.

* * * * *